United States Patent [19]

Bessinger

[11] Patent Number: 4,738,426

[45] Date of Patent: Apr. 19, 1988

[54] RESILIENT SLEEVE GLASS SHELF BRACKET

[75] Inventor: Walter L. Bessinger, Grand Haven, Mich.

[73] Assignee: Knape & Vogt Manufacturing Company, Grand Rapids, Mich.

[21] Appl. No.: 97,503

[22] Filed: Sep. 16, 1987

Related U.S. Application Data

[63] Continuation of Ser. No. 29,237, Mar. 23, 1987, abandoned.

[51] Int. Cl.[4] ..... A47G 29/02

[52] U.S. Cl. ..... 248/250; 108/152; 211/90

[58] Field of Search ..... 248/250, 235, 231.7, 248/243; 108/152, 107, 108; 211/90, 134, 186, 187

[56] References Cited

U.S. PATENT DOCUMENTS

| | | | |
|---|---|---|---|
| 564,519 | 7/1896 | Hevsinger . | |
| 883,323 | 3/1908 | MacDuff | 248/250 |
| 1,878,850 | 9/1932 | Hilgers | 248/231.7 |
| 2,477,771 | 8/1949 | Sanford | 248/250 X |
| 2,971,657 | 2/1961 | Zadek | 108/152 X |
| 3,034,757 | 5/1962 | Suben . | |
| 3,437,214 | 4/1969 | Sainbury | 211/90 |
| 4,375,565 | 5/1983 | Roberts et al. . | |
| 4,444,321 | 4/1984 | Carlstrom | 248/235 |
| 4,508,301 | 4/1985 | Nicholson et al. . | |

FOREIGN PATENT DOCUMENTS

| | | |
|---|---|---|
| 811370 | 8/1951 | Fed. Rep. of Germany . |
| 1534744 | 7/1969 | Fed. Rep. of Germany . |
| 1400793 | 7/1969 | Fed. Rep. of Germany . |
| 2749477 | 5/1979 | Fed. Rep. of Germany . |
| 2155310 | 9/1985 | United Kingdom . |

OTHER PUBLICATIONS

Chainport Design/Exhibit A, published 5-1969.

*Primary Examiner*—J. Franklin Foss

*Attorney, Agent, or Firm*—Price, Heneveld, Cooper, DeWitt & Litton

[57] ABSTRACT

A support bracket assembly for a glass or marble shelf panel has a laterally oriented throat and a generally U-shaped resilient interface strip fitted over the rear edge of the shelf panel and received within the shelf bracket. The top of the interface strip is biased against the top of the throat to retain the shelf panel in the support bracket.

16 Claims, 1 Drawing Sheet

RESILIENT SLEEVE GLASS SHELF BRACKET

This is a continuation of application Ser. No. 029,237, filed Mar. 23, 1987, now abandoned.

BACKGROUND OF THE INVENTION

This invention relates to shelf support brackets and particularly to brackets of the type that support glass and marble shelves in a cantilever fashion.

Cantilever shelf brackets for supporting inserted shelf panels, usually of wood, have been known for many years. In recent years, these have taken the form of extruded aluminum devices capable of receiving the shelf panel in a wedging action, as in U.S. Pat. Nos. 4,508,301 and 4,385,565. That is, the wood shelf panel of closely controlled thickness tolerance is placed under slightly deforming wedging stress during insertion, for secure retention of the assembled panel structure. The panel is inserted until the inner end abuts the inner end of the bracket throat. While this works very well for certain materials such as wood or particle board, it is not desirable to apply such stresses to certain other materials, particularly glass or marble. Breakage can result. This potential breakage problem is accentuated by the fact that glass panels for shelving tend to vary considerably in thickness. Therefore, a thicker panel either will not fit within the throat of the bracket, or, if sufficient force is applied to wedge it in place, the stress is immediately too great. If a thin panel is inserted, it is not securely retained. Furthermore, the potential of breakage resulting from this stress is increased if any scratching of the glass occurs. One significant cause of such scratching is the abutment engagement of the inner edge of the inserted shelf with the inner end of the bracket throat or of the bracket fastener as during insertion of the panel. Alternately, scratching can occur during the wedging type insertion of the glass panel into the metal bracket.

Aside from protection of glass and marble panels or the like from scratching, marring and localized stress, it is sometimes desirable to protect panels of fine wood and other materials during assembly of this shelving structure.

SUMMARY OF THE INVENTION

A primary object of this invention is to provide a cantilever shelf bracket capable of receiving and retaining a shelf panel such as glass or marble without scratching, marring or application of localized stress to the panel upon assembly. It is another object of the invention to accommodate significant variation in the thickness of the panel that is to be retained. According to the invention, a bracket has a laterally oriented throat and a generally U-shaped resilient interface strip fitted over the rear edge and rear portion of the shelf panel and received within the shelf bracket throat. Interlock means are provided between the top of the resilient strip and the throat for restraining movement of the shelf and biasing means on the bottom of the resilient strip are provided for biasing the top of the resilient strip and the throat together. The interface strip has a base portion to protect the rear edge of the glass from abrasion and a pair of sidewalls that converge away from the base to a dimension less than the thickness of the smallest shelf panel to be accommodated.

The interface strip is preferably placed on the rear portion of the shelf before insertion into the support bracket. This reduces the likelihood of marring or stressing of the glass during installation. Variation in glass thickness is taken up in the throat portion by the biasing means disposed between the lower portion of the throat and the bottom wall of the interface strip.

These and other related objects, advantages and features of this invention will become apparent upon review of the following specification in conjunction with the drawings.

DESCRIPTION OF THE PREFERRED EMBODIMENT

Figure 1:
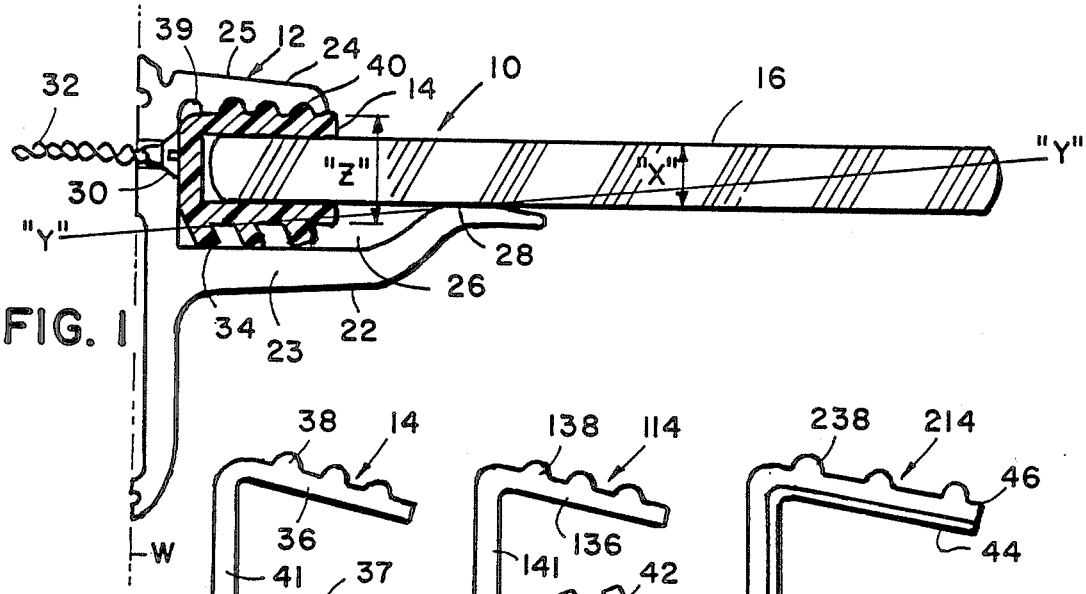
FIG. 1 is a side elevational sectional view of the novel bracket with interface strip, showing a glass shelf panel inserted therein.

Referring now specifically to the drawings and the illustrative embodiments depicted therein, the shelf and bracket assembly 10 includes a bracket 12, having a resilient interface strip 14, and cooperative with the rear portion of a glass shelf panel 16. The ends of the bracket may be covered by a pair of end caps (not shown).

Bracket 12 preferably comprises an elongated metal member formed as an extrusion of aluminum. A vertical rear panel 20 abuts the wall surface and is affixed thereto by fastener screws 32 extending through orifices 30 formed in the rear panel. Between an upper overhang 24 and a lower support platform 22 of the bracket is a receiving throat 26.

The upper overhang member 24 has an upwardly rearwardly oriented fascia surface 25 and a generally horizontal support surface 40. Support surface 40 is generally corrugated by the formation of a series of detents 39 therein. Lower support platform 22 has a first portion 23 adjacent rear panel 20 that forms the bottom of the receiving throat and a second, outer portion that defines an upwardly extending, downwardly curved, outer support surface 28 and a depression or recess between this surface 28 and rear panel 20.

Figure 2:
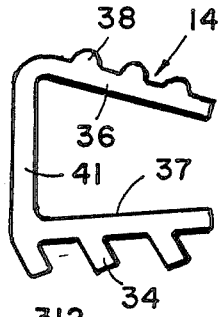
FIG. 2 is an end elevational view of the interface strip.

Interface strip 14, shown in detail in FIG. 2, is formed of a resilient polymeric material, preferably polyvinylchloride, polyurethane, polyethylene, polypropylene, copolymers or the equivalent therein, formed as by extrusion in a long strip. Interface strip 14 is of a generally U-shape configuration having a base member 41 and an upper compression member 36 and a lower compression member 37 extending from the ends of the base. The upper surface of upper compression member 36 has a series of ribs 38 that fit within detents 39 in the throat upper support surface 40 when the interface strip is in the bracket throat. A series of resilient fingers 34 extend downwardly from the lower surface of lower compression member 37 and slope downwardly away from base portion 41. Compression members 36, 37 converge away from base portion 41 and define a cavity having an opening that is less than the minimum thickness of the shelf panel to be supported by the invention. Thus, the interface strip will be frictionally retained on the rear portion of a shelf panel inserted between upper and lower compression members 36, 37.

Referring to FIG. 1, a shelf panel 16 is shown having an interface strip 14 affixed to its rear portion and inserted within the support bracket 12. Ribs 38 on the interface strip 14 engage detents 39 to provide lateral restraint between the support bracket and the interface strip. Fingers 34 are compressed between lower compression member 37 and portion 23 of the lower support platform placing an upward bias on the interface strip and hence the interface between upper compression member 36 and upper support surface 40. The downwardly, outwardly orientation of fingers 34 additionally increases the resistance of the insert strip to pulling out of the throat 26. The upward bias from fingers 34 additionally increases the lateral friction retention force between upper and lower compression members 36, 37 and the shelf plate 16 giving additional resistance against lateral removal.

The line y—y in FIG. 1 demonstrates the centerline or bottom surface of an inserted shelf panel having a thickness greater than X. The increased thickness will cause the lower compression member 37 to be located lower in the throat 26. This downwardly offset location of the interface strip is accommodated by increased compression of fingers 34. The centerline or bottom surface of the shelf plate is thus offset counterclockwise as compared with a less thick shelf. Such an offset would be essentially imperceivable to the user and would, therefore, not be an aesthetic concern. The offset of the centerline or bottom surface of the panel will alter the point on outer support surface 28 that supports the shelf. The large radius or cam-like curvature of outer support surface 28 will accommodate such displacement while providing reduced stress support for the shelf 16, by always providing a contact point that is not a sharp edge.

Figure 3:
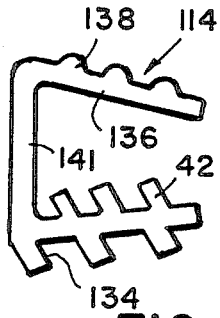
FIG. 3 is a modified version of the interface strip shown in FIG. 2.

A modified configuration of interface strip 14 is shown in FIG. 3. A set of barbs 42 are shown extending upwardly from the lower compression member 37 and upwardly rearwardly towards the base portion 141. Barbs 42 will flex inwardly of the cavity upon engagement thereof by an inserted rear portion of a shelf panel. Barbs 42 thus provide additional gripping force on the shelf panel.

Figure 4:
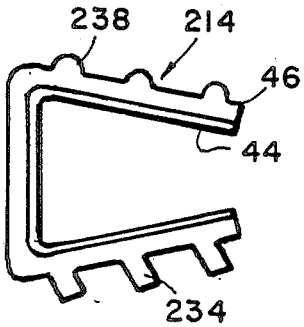
FIG. 4 is another modified version of the insert strip shown in FIG. 2.

Another configuration of interface strip 14 is shown in FIG. 4. The interface strip is a dual durometer laminate with an inner contact surface 44 that is relatively soft and resilient in comparison with an outer mounting surface 46. The purpose of this laminate construction is to allow a more resilient material to be used in the interface strip to increase the biasing force produced by fingers 234 while still providing a soft gripping surface for interfacing with the shelf panel 16.

Figure 5:
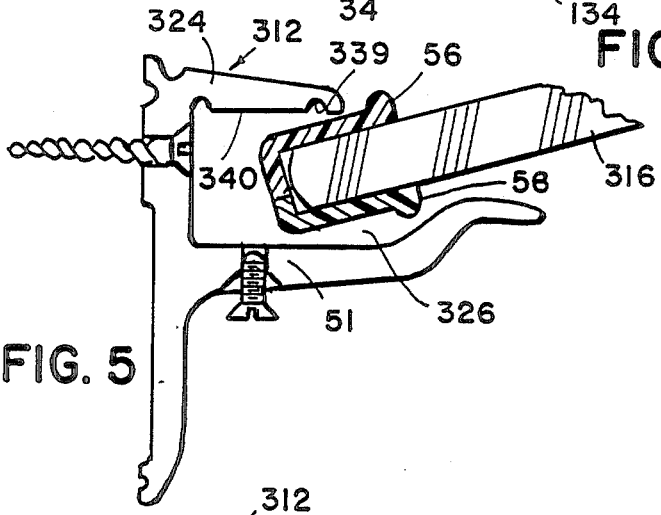
FIG. 5 is a side elevational sectional view of an alternative embodiment of the novel bracket, showing a glass panel with an attached interface strip being inserted.
Figure 7:
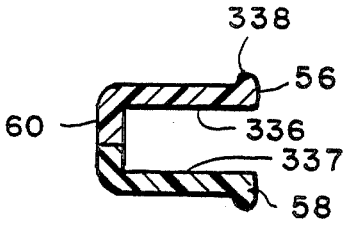
FIG. 7 is an enlarged end elevational view of the interface strip shown in FIG. 5.
Figure 6:
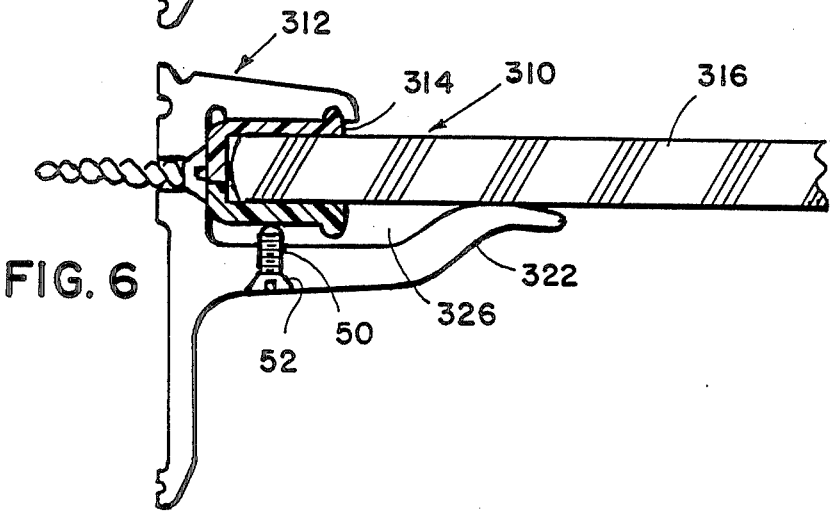
FIG. 6 is the same view as FIG. 5 with the glass panel fully inserted.

An alternative, but not necessarily preferred, embodiment of the invention is shown in FIGS. 5-7. Support bracket 312 is similar to the one in the prior embodiment except that a countersunk threaded aperture 51 is formed in lower support platform 322 and an adjustment screw 50 extends through aperture 51 into throat 326. A modified interface strip 314, shown in FIG. 7, is provided. In this embodiment, the upper wall 56 and lower wall 58 of the interface strip are made from different durometer PVC materials or the equivalent. Upper wall 56 is of a softer, more flexible polymer and lower wall 58 is of a more rigid polymer. Rear wall 60 is an extension of upper wall 56 and is made from the same softer material.

FIG. 5 shows a shelf panel having an interface strip on its rear portion being inserted into a support bracket 312. Resilient upper wall 56 engages upper support surface 340 and rigid lower wall 58 is disposed above adjustment screw 50. Adjustment screw 50 is rotated into contact with lower wall 58 and is further rotated to bias upper wall 56 into firm engagement with upper support surface 340. The use of a softer, more flexible polymer material in the upper wall increases the interlock with the upper support surface to provide increased lateral resistance to pulling the shelf out of the support. The user of a softer, more flexible material for the rear wall 60 provides a cushion between the rear edge of the shelf panel and the support bracket to prevent chipping of the rear edge of the panel. The rigid lower wall 58 provides a durable surface for interaction with adjustment screw 50. The resilience in upper wall 56 and rear wall 60 accommodates variations in the thickness of shelf panels. The adjustability derived from adjustment screw 50 accommodates the various thickness panels within the throat portion 326.

Changes and modifications in the specifically described embodiments can be carried out without departing from the scope of the invention which is intended to be limited only by the scope of the appended claims.

The embodiments of the invention in which an exclusive property or privilege is claimed are defined as follows.

1. A cantilever shelf support for a shelf having a rear portion comprising:

a bracket having a laterally oriented throat to receive the rear portion of a shelf;

said throat having a lower support platform forming a bottom, an upper overhang forming a top and an inner end;

a resilient interface strip in said throat;

said interface strip of generally U-shape and having a base portion and a pair of walls defining a cavity, said walls extending from said base and spaced apart approximately the thickness of a rear portion of a shelf inserted between said walls;

said throat top and one of said strip walls having abutting surfaces defining interlock means for restraining movement between said surfaces; and biasing means operative between said throat bottom and the other of said strip walls for biasing said abutting surfaces together.

2. The shelf support in claim 1 wherein said interlock means comprises a rib on one of said abutting surfaces and a groove on the other of said abutting surfaces.

3. The shelf support in claim 2 wherein the rib is on the one of said abutting surfaces defined by said strip wall.

4. The shelf support of claim 1 wherein said biasing means comprises resilient finger means extending from said other of said strip walls toward, and for engagement with, said throat bottom, said finger means being in compression.

5. The shelf support in claim 4 wherein said finger means slope downwardly away from said interface strip base portion.

6. The shelf support in claim 4 further having barb means extending from said other of said strip walls toward said one of said strip walls and being resiliently flexible inwardly of said throat for engagement thereof, and inward flexure thereof, by an inserted rear portion of a shelf.

7. The shelf support in claim 1 wherein said interface strip base portion and walls are each a laminate of two polymeric materials.

8. The shelf support in claim 7 wherein one of said polymeric materials is more flexible than the other and the more flexible material is facing said cavity for engagement by an inserted rear portion of a shelf.

9. The shelf support in claim 1 wherein said interface strip walls converge away from said base.

10. The shelf support in claim 1 wherein said lower support platform comprises a recessed support surface and an elevated support surface, said recessed support surface defining said throat bottom and said elevated support surface being outward of said throat and defining additional means for supporting an inserted rear portion of a shelf.

11. A cantilever shelf support for a shelf having a rear portion comprising:

a bracket having a laterally oriented throat to receive the rear portion of the shelf;

said throat having a lower support platform forming a bottom and an upper overhang forming a top;

a generally U-shaped interface strip in said throat;

said strip having a resilient upper wall adjacent said throat top and a lower wall adjacent said throat bottom; and biasing means between said strip lower wall and said throat bottom for biasing said strip upper wall against said throat top.

12. The shelf support of claim 11 wherein said strip lower wall is rigid.

13. The shelf support of claim 12 wherein aid biasing means comprises an adjustment screw extending from said lower support surface into engagement with said strip lower wall.

14. The shelf support of claim 11 wherein said strip further comprises a base portion between said upper and lower walls and of the same material as said upper wall.

15. The shelf support of claim 11 further comprising a rib extending from one of said strip upper wall and said throat top engaged in a detent in the other of said strip upper wall and said throat top.

16. The shelf support of claim 15 wherein the rib is on the strip upper wall.

* * * * *